United States Patent [19]

Raasch et al.

[11] Patent Number: 4,492,077

[45] Date of Patent: Jan. 8, 1985

[54] SPINNING ROTOR FOR AN OPEN-END SPINNING MACHINE AND METHOD OF CONSTRUCTION THEREOF

[75] Inventors: Hans Raasch, Monchen-Gladbach; Dieter Busch, Wegberg, both of Fed. Rep. of Germany

[73] Assignee: W. Schlafhorst & Co., Monchen-Gladbach, Fed. Rep. of Germany

[21] Appl. No.: 407,612

[22] Filed: Aug. 12, 1982

[30] Foreign Application Priority Data

Aug. 14, 1981 [DE] Fed. Rep. of Germany ..... 3132131
Nov. 7, 1981 [DE] Fed. Rep. of Germany ..... 3144383

[51] Int. Cl.[3] ..... D01H 1/12
[52] U.S. Cl. ..... 57/414; 57/416
[58] Field of Search ..... 57/414, 400, 403, 404, 57/416

[56] References Cited

U.S. PATENT DOCUMENTS

| | | | |
|---|---|---|---|
| 3,439,487 | 4/1969 | Landwehrkamp et al. | 57/414 |
| 4,167,846 | 9/1979 | Shaw | 57/414 |
| 4,193,253 | 3/1980 | Herbert et al. | 57/414 |
| 4,358,922 | 11/1982 | Feldstein | 57/414 X |
| 4,358,923 | 11/1982 | Feldstein | 57/414 X |

*Primary Examiner*—Donald Watkins
*Attorney, Agent, or Firm*—Herbert L. Lerner; Laurence A. Greenberg

[57] ABSTRACT

Spinning rotor for an open-end spinning machine including a rotational body having a hollow interior, the body being formed of steel and having thereon a surface layer formed of at least one of the compounds iron carbide, iron boride, iron silicide and iron nitride at least at locations of the hollow interior thereof at which the spinning rotor comes into contact with spinning fibers being spun into a thread, the steel body with the surface layer thereon being tempered and having increased ductility at high elastic limits, and a method of manufacturing a spinning rotor.

9 Claims, 1 Drawing Figure

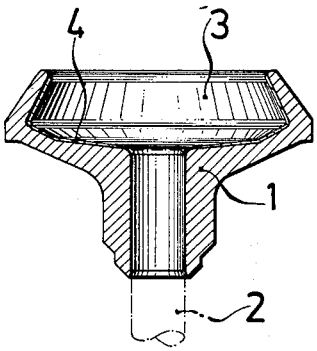
4
3
1
2

SPINNING ROTOR FOR AN OPEN-END SPINNING MACHINE AND METHOD OF CONSTRUCTION THEREOF

The invention relates to a spinning rotor for an open-end spinning machine and a method of production or construction thereof.

In open-end spinning machines, the spinning rotors therein are subject to considerable wear at the locations thereof at which they come into contact with the fibers and with the threads or yarn in the process of formation, respectively. This is disadvantageous, in that the form and surface structure of the spinning rotor has a great effect upon the structure of the spun thread or yarn and upon the spinning stability of the rotor.

In heretofore-known open-end spinning machines, due to wear of the rotor, marked variations in the surface structure and surface condition at the inside of the spinning rotor have occurred heretofore, during the spinning operation, at the locations which are contacted by the fibers and the threads or yarns, respectively. This produced disadvantageous consequences for the condition of the thread and the stability of the spinning operation.

Demand for a wear-resistant surface results therefrom. On the other hand, it appears to be wise to increase the efficiency of an open-end spinning device so that the rotary speed of the rotor is increased. Both of the foregoing demands or requirements are in variance with one another in that a wear-resistant material is generally brittle and has little tensility, yet a high rotary speed of a rotor demands a tensile, ductile material at high elastic limits.

It is accordingly an object of the invention to provide a spinning rotor which, even with increasing operating duration, will produce a thread of uniform condition and maintain the stability of the spinning operation, yet simultaneously afford a high rotary speed and, thereby, an elevated productivity of the spinning machine, at low expense in material and energy.

With the foregoing and other objects in view, there is provided, in accordance with the invention, a spinning rotor for an open-end spinning machine comprising a rotational body having a hollow interior, the body being formed of heat-treatable steel and having thereon a surface layer formed of at least one of the compounds consisting of iron carbide, iron boride, iron silicide, and iron nitride at least at locations of the hollow interior thereof at which the spinning rotor comes into contact with spinning fibers being spun into a thread or yarn, the steel body with the surface layer thereon being tempered and having thereby an increased ductility at high elastic limits. A rotor thus formed combines a wear-resistant, hard, yet relatively brittle surface condition with material properties which are advantageous with respect to the stressing which occurs at high rotary speeds.

In order thereby to prepare the surface of the spinning rotor and to make it corrosion-resistant so that a thread of uniform quality or structure is produced even as the duration of operation increases and the stability of the spinning process is maintained; and in order to attain a high rotor speed during the spinning operation for a relatively small expense in material and energy and thereby making possible increased productivity of the spinning machine, the spinning rotor has been provided, in accordance with other features of the invention, with a protective surface layer containing a foreign metal such as a zinc layer or a nickel layer, for example, which are able to be produced in an especially simple manner.

Advantages of the device of the invention are especially in that, over a relatively long period of time, good, uniform spinning results are obtained wherein the speed of the rotor and, accordingly, production are increased. By means of an effective protection against corrosion, the good properties of the spinning rotor with respect to wear-resistance are maintained.

In accordance with a further feature of the invention, the spinning rotor has a protective surface coating formed of at least two layers of the same or other metals.

In accordance with an added feature of the invention, the outer layer of the at least two layers is formed of a metal resistant to corrosion and/or wear.

In accordance with an additional feature of the invention, the protective surface layer has an outer skin formed of a chemical compound of a metal with an inorganic substance.

In accordance with more specific features of the invention, the outer skin of the protective surface layer is formed of oxide, phosphate or chromate.

In accordance with another aspect of the invention, there is provided a method of manufacturing a spinning rotor for an open-end spinning machine which comprises prefabricating a rotational body having a hollow interior out of heat-treatable steel, forming a surface layer thereon of at least one of the compounds selected from the group consisting of iron carbide, iron boride, iron silicide and iron nitride at least at locations of the hollow interior of the rotational body at which the spinning rotor comes into contact with spinning fibers being spun into a thread, heat-treating the spinning rotor so as to temper the material thereof and thereby increase the ductility of the material at high elastic limits.

In accordance with another mode, the method includes, after forming the surface layer, (a) heat-treating the rotational body with the surface layer formed thereon so as to temper the material thereof and thereby increase the ductility of the material at high elastic limits, and (b) applying a protective surface layer containing a foreign metal to the spinning rotor, in either the foregoing or reversed sequence.

In accordance with a further mode of the invention, the method comprises contacting the surface of the spinning rotor at high temperatures with a carbon-containing, boron-containing, silicon-containing, nitrogen-containing or ammonium-containing medium, and then, in the following or reversed sequence:

(a) heating the spinning rotor and cooling it down again, and (b) applying the protective surface layer to the spinning rotor.

In accordance with an added mode of the method according to the invention, the boron-containing medium is a boron-containing paste or boron-containing powder.

In accordance with an additional mode, the method, after forming the surface layer by heating to a given temperature, includes heating the rotational body with the surface layer formed thereon to a temperature below the given temperature, then quenching and thereafter tempering the rotational body with the surface layer formed thereon, and applying a protective surface layer to the rotational body with the surface layer formed thereon.

In accordance with yet another mode, the method of the invention includes, after forming the surface layer, (a) heating the spinning rotor to a temperature of from 820° C. to 840° C., thereafter quenching the spinning rotor and tempering it to from 380° C. to 420° C., and (b) applying a protective surface layer to the spinning rotor.

In accordance with alternative modes of the invention, the method comprises metal-spraying a protective surface layer on the spinning rotor, galvanizing a protective surface layer on the spinning rotor, forming a protective surface layer on the spinning rotor by immersing the spinning rotor in a bath containing liquid metal or exposing the spinning rotor to vaporous or gaseous metal so as to form the protective surface layer by diffusion. The last mentioned technique is preferred at this time especially with respect to quality and expense.

In accordance with another mode, the method according to the invention includes, after applying the metal-containing protective surface layer to the spinning rotor, again heating or annealing the spinning rotor so as to diffuse the foreign metal partly into the steel of the rotational body. A good anchoring or tying of the protective layer to the rotor material is thereby achieved.

The formation of the protective surface layer by diffusion is especially advantageous and the protective surface layer has especially good properties when, in accordance with a further mode of the method invention, the foreign metal is chromium, and a bond between the steel and the foreign metal is formed by chrome-alloying.

The protective surface layer per se may be improved even further. To this end, in accordance with an added mode, the method of the invention comprises forming the protective surface layer with an outer skin made up of a chemical compound of a metal with an inorganic substance.

In accordance with alternative modes, the selection of which depends upon the spinning conditions, the method of the invention comprises oxidizing, phosphatizing or chromatizing the spinning rotor.

In accordance with further details of the alternative modes, the method according to the invention includes oxidizing the spinning rotor in a process selected from the group consisting of chemical, electrochemical and anodic oxidation processes, phosphatizing the spinning rotor in a process selected from the group consisting of atramentizing, bonderizing and parkerizing processes or chromatizing the spinning rotor in a process selected from the group consisting of immersion in a dichromate solution followed by rinsing in water, and electrochemical chromatization.

Moreover, in accordance with yet another mode of the invention, the method includes oxidizing and chromatizing the spinning rotor in one operation to form the protective surface layer.

Further, in accordance with the invention, the method comprises immersing the spinning rotor in a hot solution of sodium carbonate and sodium chromate so as to oxidize and chromatize the spinning rotor in the one operation.

Additionally, in accordance with the invention, the method includes boiling the thus-produced oxide layer forming the outer skin in water glass and subsequently heating it to strengthen it.

In accordance with a concomitant mode, the method of the invention includes heating the spinning rotor, in a final operation, to about 200° C. in a hydrogen atmosphere and then cooling it again so as to eliminate any embrittlement of the material of the spinning rotor which may have occurred during the preceding process steps.

Other features which are considered as characteristic for the invention are set forth in the appended claims.

Although the invention is illustrated and described herein as embodied in a spinning rotor for an open-end spinning machine and method of construction thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a longitudinal sectional view of a spinning rotor according to the invention.

Referring now to the FIGURE of the drawing, there is shown therein a spinning rotor 1 prefabricated of hardenable or temperable steel. During final assembly a shaft 2 of steel is later insertable therein. After the spinning rotor 1 had been prefabricated on a lathe, the bore thereof into which the shaft 2 is to be inserted later, was provisionally closed with a heat-resistant material. The entire inner space 3 was then filled with a boron-containing powder. With the opening of the spinning rotor 1 facing upwardly, the spinning rotor 1 was then placed in a retort and under protective gas brought up to a temperature of 920° C. After subsequent cooling, excess, non-consumed boron-containing powder was removed from the inner space 3. Thereafter, the spinning rotor 1 was again heated under protective gas in a retort up to 830° C., and immediately thereafter quenched in oil. The spinning rotor 1 was, thereupon, tempered in a neutral salt bath at a temperature of 400° C. and again quenched in oil. Then, the spinning rotor 1 was zinc-coated or galvanized.

The spinning rotor 1 fabricated in this manner then received a shaft 2 which was brought up to a rotary speed of 200,000 RPM. During a trial run and after the trial run no changes at all in the spinning rotor 1 were apparent. Thereafter, the spinning rotor 1 produced the anticipated good spinning results in the spinning tryout or test.

Alternatively, the boron-containing medium can be composed of a boron-containing paste, a boron-containing liquid or a boron-containing gas. A paste or a liquid is applied by spreading or brushing, by immersion or by spraying. Thereafter, the spinning rotor 1 must first be dried once before further processing or treatment.

The completed spinning rotor 1 has an exceptionally wear-resistant surface layer 4 of iron boride which is provided with a protective surface layer of zinc. This protective surface layer not only protects the respective spinning rotors from corrosion but also is the reason for a further improvement in the spinning results.

The foregoing is a description corresponding to German application P No. 31 32 131.3, dated Aug. 14, 1981 and German application P No. 31 44 383.4, dated Nov.

7, 1981, the International priorities of which are being claimed for the instant application, and which are hereby made part of this application. Any discrepancies between the foregoing specification and the aforementioned corresponding German applications are to be resolved in favor of the latter.

We claim:

1. Spinning rotor for an open-end spinning machine comprising a rotational body having a hollow interior, said body being formed of steel and having thereon a surface layer formed of at least one of the compounds iron carbide, iron boride, iron silicide and iron nitride at least at locations of said hollow interior thereof at which the spinning rotor comes into contact with spinning fibers spun into a thread, said steel body with said surface layer thereon having been heat-treated in a process wherein it had been hardened by being heated to a given temperature, then quenched in liquid, and thereafter tempered and having increased ductility at high elastic limits.

2. Spinning rotor according to claim 1 having a protective surface layer containing a foreign metal.

3. Spinning rotor according to claim 2 wherein said protective surface layer is a zinc layer or a nickel layer.

4. Spinning rotor according to claim 1 having a protective surface coating formed of at least two layers of the same or other metals.

5. Spinning rotor according to claim 4 wherein the outer layer of said at least two layers is formed of a metal which is resistant to corrosion.

6. Spinning rotor according to claim 4 wherein the outer layer of said at least two layers is formed of a metal which is resistant to wear.

7. Spinning rotor according to claim 6 wherein said metal of said outer layer is also resistant to corrosion.

8. Spinning rotor according to claim 1 having a protective surface layer containing a foreign metal, said protective surface layer having an outer skin formed of a chemical compound of a metal with an inorganic substance.

9. Spinning rotor according to claim 8 wherein said outer skin of said protective surface layer is formed of oxide, phosphate or chromate.

* * * * *